United States Patent [19]

Bellows et al.

[11] Patent Number: 4,472,701

[45] Date of Patent: Sep. 18, 1984

[54] ELECTRICAL CIRCUIT BREAKER

[75] Inventors: Alfred H. Bellows; Robert B. Piejak, both of Wayland, Mass.

[73] Assignee: GTE Laboratories Incorporated, Waltham, Mass.

[21] Appl. No.: 484,775

[22] Filed: Apr. 14, 1983

[51] Int. Cl.[3] ..... H01H 3/00; H01H 71/16

[52] U.S. Cl. ..... 335/23; 335/35; 335/191; 200/153 G; 200/243

[58] Field of Search ..... 335/15, 16, 23, 35, 335/185, 186, 188, 191, 192, 194, 195; 200/153 G, 243, 244

[56] References Cited

U.S. PATENT DOCUMENTS 3,193,643 7/1965 Hollyday ..... 335/191

*Primary Examiner*—E. A. Goldberg
*Assistant Examiner*—George Andrews
*Attorney, Agent, or Firm*—David M. Keay

[57] ABSTRACT

A circuit breaker having a contact opening and closing mechanism including a contact actuator member which is moved between a first position and a second position to close and open the contacts. The movable contact is mounted on one end of a contact carrier which is pivotally mounted at its central region to the contact actuator member. A leaf spring is positioned between the other end of the contact carrier and the circuit breaker case. When the contact actuator member is in the first position, the leaf spring produces a torque on the contact carrier in one direction about the pivot forcing the contacts closed. When the contact actuator member moves from the first position toward the second, the leaf spring becomes ineffective and a torsion spring which engages the contact carrier and the contact actuator arm produces a torque pivoting the contact carrier in the opposite direction thus enhancing the contact opening process.

10 Claims, 2 Drawing Figures

39. The two arms 39 are held together by a portion 40 of the member at the other end. During normal on-off operation (not tripped) a tang in the portion 40 at the other end is held by a latch 62 so that the trip member 38 remains fixed with respect to the supporting structure. A tension spring 50 is connected between the upper portion of the operating handle 35 and the pivot shaft 42 at the coupling between the actuator links 36 and the trip links 37. The tension spring 50 is located centrally between the two arms 34 (only one of which is shown in FIG. 1) of the operating handle 35, the two arms 39 of the trip member 38, the two actuator links 36, and the two trip links 37. Each arm of the operating handle 35 is pivotally supported at its lower end at a pivot connection (not shown) with the supporting structure.

The overload mechanism for sensing an overload condition and causing tripping of the breaker includes the bimetallic element 24, the latch 62, and a releasing or unlatching member 60. The releasing member 60 is pivotally mounted to the supporting structure at pivot points 61, and the latch 62 pivots about pivot points 63 in the supporting structure. Under normal conditions of no overload a tension spring 65 urges the releasing arm 60 into position so that it is engaged by the latch 62 which is urged against it by a tension spring 64. The trip member 38 engages the latch 62 maintaining the trip member 38 fixed in position.

The overcenter toggle mechanism operates to shift the contact actuator member 31 between the first position as shown in FIG. 1 in which the contacts are closed and the second position in which the contacts are open. With the operating handle 35 in the position as shown in FIG. 1 the operating tension spring 50 tends to urge the shaft 42 to the left as shown in the figure. The left edges of the trip links 37 abut stops 46 on the trip member 38 to hold them in the position shown in FIG. 1. The actuator links 36 thus transmit a force to the contact actuator member 31 maintaining it in the first position as shown in FIG. 1.

When the operating handle 35 is rotated in the clockwise direction as viewed in FIG. 1, the centerline of the operating spring 50 is carried to the other side of the pivot points 43 of the trip links 37. The force of the operating spring 50 on the shaft 42 pivots the trip links 37 about the pivots 43 moving the shaft 42 upward and to the right. This action causes the actuator links 36 to pull upward on the contact actuator member 31 pivoting it about the pivots 45 to the second position. The resulting action of the contact carrier 22 to open the contacts will be explained in detail hereinbelow.

In response to an overload condition the bimetallic element 24 bends causing its upper portion to move to the right as viewed in FIG. 1 pushing against the releasing member 60 and pivoting it in a clockwise direction against the bias of the tension spring 65. Movement of the releasing member 60 in a clockwise direction about its pivot points 61 releases the latch 62 which in turn is pivoted in a clockwise direction about the pivots 63 by the tension spring 64. Movement of the latch 62 releases the trip member 38 and the force of the operating spring 50 causes the trip arm 38 to pivot in a counterclockwise direction about the pivots 44 which are fixed in the supporting structure. This action pulls up the links 37 and 36 causing the contact actuator member 31 to pivot in a clockwise direction to its second position thus causing the contacts to open. The elements of the circuit breaker are reset from the tripped condition to the normal off condition by rotating the operating handle 35 clockwise to its fully off position. During this movement a pin 52 in the operating handle 35 pushes against the arms 39 of the trip member 38 forcing the trip member 38 back into position to be engaged by the latch 62. The toggle and overload mechanisms as described which drive the contact actuator member 31 are conventional and of a type generally well known in the circuit breaker art.

In circuit breakers in accordance with the present invention the manner in which the contacts make and break connections is determined by an arrangement including the contact actuator member 31, the contact carrier 22, and associated elements. As illustrated in FIG. 1 the movable contact 21 is mounted at one end 75 of the contact carrier 22. The other end 74 bears against a leaf spring 72 which is mounted on the supporting structure, specifically the case 10.

When the circuit breaker is in the on condition as shown in FIG. 1 with the contact actuator member 31 in its first position, the contact carrier 22 assumes the position shown. The movable contact 21 at the one end 75 of the contact carrier 22 is in contact with the fixed contact 13. The region at the other end 74 of the contact carrier 22 is forced against the leaf spring 72 deflecting it by a particular amount. The leaf spring 72 tends to pivot the contact carrier 22 in a counterclockwise direction about the pivot connection 71 with the contact actuator member 31. Since the leaf spring 72 produces a much greater torque than the torsion spring 73, the torsion spring 73 has no effect when the elements are in the position illustrated in FIG. 1. Thus, the force holding the movable contact 21 against the fixed contact 13 is the counterclockwise torque produced by the leaf spring 72 acting about the pivot 71.

As explained previously the contact actuator member 31 may be moved from the first position as shown in FIG. 1 to a second position in which the contacts are fully open either by actuating the operating handle 35 or automatically in response to an overload condition. In either event the contact actuator member 31 rotates in a clockwise direction about the pivot 45. FIG. 2 illustrates certain elements of the circuit breaker after the opening action has started. The leaf spring 72 had been compressed or deflected by a small amount and, therefore, is effective for only a limited distance. When the contact actuator member 31 moves a predetermined distance moving the end 74 of the contact carrier 22 by the amount the leaf spring 72 was deflected, the leaf spring ceases to exert a significant force on the contact carrier. Movement of the contact actuator member 31 carrying the contact carrier 22 along with it also moves the movable contact 21 away from the fixed contact 13. As soon as the leaf spring 72 becomes ineffective, the torsion spring 73 becomes effective to rotate the contact carrier 22 in the clockwise direction about the pivot connection 71 of the contact carrier 22 with the contact actuator member 31. This reversal of the torque applied to the contact carrier 22 increases the force separating the movable contact 21 from the fixed contact 13 and also increases both the speed and distance of separation. Although pivoting of the contact carrier 22 about the pivot point may cause the other end 74 of the contact carrier 22 to contact the leaf spring 72, the leaf spring 72 will exert no effective force on the contact carrier 22.

Thus the mechanism for opening the contacts of a circuit breaker in accordance with the invention produces a faster and more positive opening effect. The leaf

ELECTRICAL CIRCUIT BREAKER

BACKGROUND OF THE INVENTION

This invention relates to circuit breakers. More particularly, it is concerned with circuit breaker contact closing and opening mechanisms.

Circuit breakers typically employ a pair of separable contacts one fixed and one movable with the movable contact connected to an operating mechanism for opening and closing the contacts in response to manual operation of an operating handle. Circuit breakers also include a mechanism for automatically opening the contacts upon the occurrence of an overload condition. The handle is connected to the movable contact through a toggle arrangement, typically a spring operated overcenter linkage. The overload mechanism includes a sensing member such as a bimetallic and/or magnetic element which trips the toggle arrangement to produce rapid opening of the contacts upon sensing of an overload condition.

The toggle arrangement typically includes a large operating spring in order to provide rapid switching action. In certain breakers the operating spring has no direct effect on the force exerted by the movable contact against the fixed contact. A separate and smaller spring is used to generate the desired contact pressure. Upon opening of the contacts, however, either by tripping or by manual operation the contact spring tends to urge the movable contact toward the fixed contact. Thus, separation of the contacts is delayed, and the force on the contacts decreases continuously throughout the time of delay resulting in a period of inadequate contact force. Furthermore, the distance between the fully opened contacts is reduced by the amount of movement imparted by the contact spring.

SUMMARY OF THE INVENTION

A circuit breaker in accordance with the present invention includes an improved contact closing and opening mechanism. The circuit breaker comprises supporting structure with a fixed contact mounted on the supporting structure. A contact carrier member having opposite first and second ends has a movable contact mounted adjacent to the first end. A contact actuator member is mounted in the supporting structure and is movable between a first position and a second position. The contact carrier member is pivotally mounted on the contact actuator member at a region of the contact carrier member which is between the first and second ends. A first biasing means bears against the contact actuator member and against a portion of the contact carrier member. The first biasing means tends to rotate the contact carrier member in one direction with respect to the contact actuator member. A second biasing means is between a region of the supporting structure and a region of the contact carrier member adjacent to its second end. The second biasing means is operable to rotate the contact carrier member in the opposite direction with respect to the contact actuator member to urge the movable contact against the fixed contact when the contact actuator member is in the first position. The second biasing means becomes ineffective to rotate the contact carrier member in the opposite direction upon movement of the contact actuator member a predetermined distance from the first position toward the second position. The first biasing means operates to rotate the contact carrier member in the one direction in response to the second biasing means becoming ineffective to rotate the contact carrier member in the opposite direction upon movement of the contact actuator member the predetermined distance from the first position toward the second position.

For a better understanding of the present invention, together with other and further objects, advantages, and capabilities thereof, reference is made to the following disclosure and appended claims in connection with the above-described drawings.

DETAILED DESCRIPTION OF THE INVENTION

Figure 1:
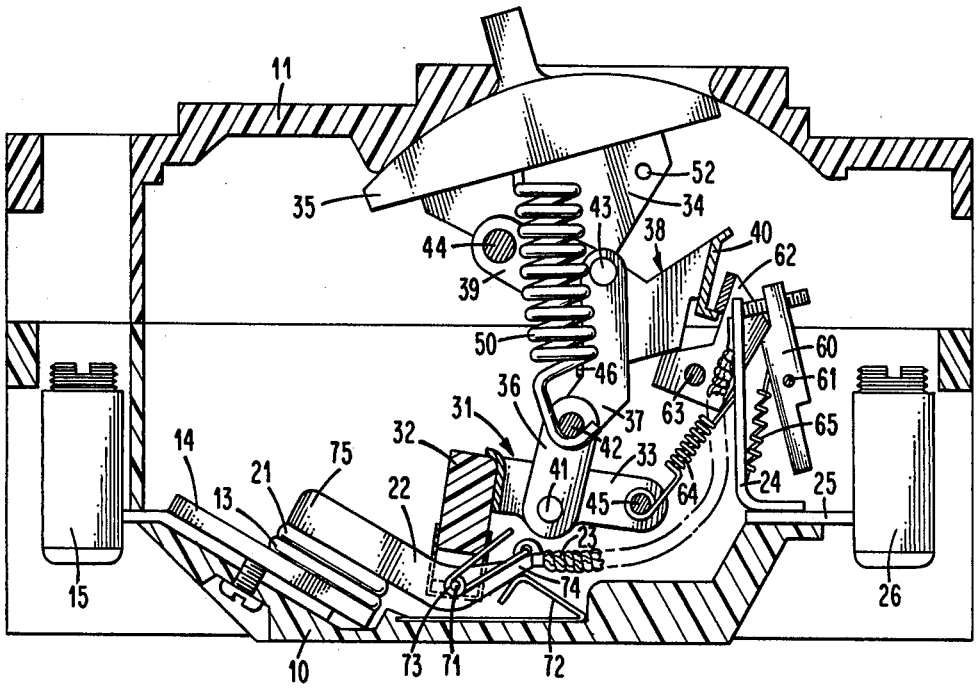
FIG. 1 is a side elevational view generally in cross section illustrating a circuit breaker in accordance with the present invention with the contacts in the closed position.
Figure 2:
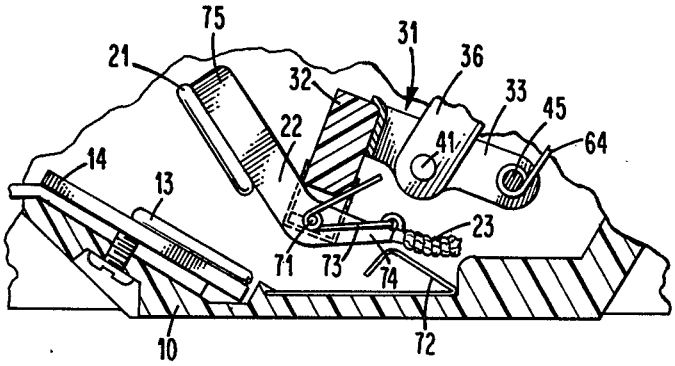
FIG. 2 is a fragmentary view of portions of the circuit breaker of FIG. 1 with the contacts in the process of moving from the closed toward the fully open position.

FIG. 1 illustrates a circuit breaker in accordance with the present invention having a housing including a case 10 of insulating material such as a molded plastic and a cover 11 of the same material. The housing together with a fixed frame (not shown) mounted in the housing provide supporting structure for the various operating elements. A fixed contact 13 is mounted in fixed relationship to the supporting structure on a contact member 14 which is connected to a load terminal 15. A movable contact 21 is mounted at one end 75 of a contact carrier or contact arm 22. The contact carrier 22 is of conductive material and a flexible cable 23 is connected between the other end 74 of the contact carrier 22 and one end of a bimetallic element 24. The other end of the bimetallic element 24 is connected as by a connecting member 25 to a line terminal 26.

The contact carrier 22 is pivotally mounted on a shaft 71 in the body portion 32 at one end of a contact actuator member 31. A torsion spring 73 bears against the body portion 32 of the contact actuator member 31 and against a portion of the contact carrier 22 between the pivot 71 and the other end 74 of the contact carrier 22. The torsion spring 73 tends to rotate the contact carrier 22 in the clockwise direction with respect to the contact actuator member 31. The contact actuator member 31 has two arms 33 (only one of which is shown in FIG. 1) and is pivotally mounted at its other end at a pivot point 45 between the arms 33 and the supporting structure. The contact actuator member 31 moves between two predetermined positions; a first position as shown in FIG. 1 in which the contacts 21 and 13 are closed and a second position in which the contacts are open.

The contact actuator member 31 is coupled to a manually operating handle 35 by way of a toggle mechanism. The toggle mechanism includes two actuator links 36 (only one of which is shown in FIG. 1) pivotally connected to the arms 33 of the contact actuator member 31 at pivots 41. Trip links 37 (only one of which is shown in FIG. 1) are pivotally connected to the actuator links 36 at a pivot shaft 42. The trip links 37 are pivotally connected to the arms 39 (only one of which is shown in FIG. 1) of a trip member 38 at pivot connections 43. The trip member 38 is pivotally mounted to the supporting structure by pivots 44 at one end of each arm spring 72 which establishes the contact pressure when the contacts are closed quickly become ineffective and does not hinder the contact opening process. When the torsion spring 73 becomes effective, it increases the speed of separation and also the distance of separation. Since the final separation of the contacts is increased, the reliability of arc quenching is enhanced and the possibility of restriking an arc is reduced.

While there has been shown and described what is at present considered a preferred embodiment of the present invention, it will be obvious to those skilled in the art that various changes and modifications may be made therein without departing from the invention as defined by the appended claims.

What is claimed is:

1. A circuit breaker comprising supporting structure;

a fixed contact mounted on said supporting structure;

a contact carrier member having opposite first and second ends with a movable contact mounted adjacent to said first end;

a contact actuator member mounted in said supporting structure and movable between a first position and a second position;

said contact carrier member being pivotally mounted on said contact actuator member at a region of the contact carrier member between said first and second ends thereof;

first biasing means bearing against the contact actuator member and against a portion of the contact carrier member and tending to rotate the contact carrier member in one direction with respect to the contact actuator member;

a second biasing means between a region of the supporting structure and a region of the contact carrier member adjacent to said second end thereof and operable to rotate the contact carrier member in the opposite direction with respect to the contact actuator member to urge the movable contact against the fixed contact when the contact actuator member is in said first position;

said second biasing means becoming ineffective to rotate the contact carrier member in the opposite direction upon movement of the contact actuator member a predetermined distance from said first position toward said second position; and said first biasing means being operable to rotate the contact carrier member in the one direction in response to the second biasing means becoming ineffective to rotate the contact carrier member in the opposite direction upon movement of the contact actuator member said predetermined distance from said first position toward said second position.

2. A circuit breaker in accordance with claim 1 including manually operated means for selectively moving said contact actuator member between said first and second positions to selectively close and open the contacts.

3. A circuit breaker in accordance with claim 2 including tripping means for moving said contact actuator member from the first to the second position in response to an overload condition.

4. A circuit breaker in accordance with claim 1 wherein said first biasing means includes a first spring bearing against said contact actuator member and said portion of the contact carrier member.

5. A circuit breaker in accordance with claim 4 wherein said second biasing means includes a second spring which is effective for a limited distance to render the second spring ineffective to produce a significant force between said region of the supporting structure and said region of the contact carrier member adjacent to said second end upon movement of the contact actuator member said predetermined distance.

6. A circuit breaker in accordance with claim 5 wherein said second spring produces a torque tending to rotate the contact carrier member in said opposite direction greater than the torque produced by said first spring tending to rotate the contact carrier member in said one direction when the contact actuator member is in said first position.

7. A circuit breaker in accordance with claim 6 wherein said second biasing means includes a leaf spring mounted on said region of the supporting structure;

said region of the contact carrier member adjacent to said second end deflects said leaf spring a predetermined amount from its undeflected condition when the contact actuator member is in said first position;

said region of the contact carrier member adjacent to said second end being moved said second predetermined amount upon movement of the contact actuator member said predetermined distance.

8. A circuit breaker in accordance with claim 7 wherein said contact actuator member has a first and a second end;

said contact carrier member is pivotally mounted on said contact actuator member at a pivot point adjacent to said first end of the contact actuator member;

the contact actuator member is pivotally mounted with respect to said supporting structure at a pivot point adjacent to said second end; and said first biasing means includes a torsion spring bearing against said portion of the contact carrier member, said portion lying between the pivot point of the contact carrier member on the contact actuator member and said second end of the contact carrier member.

9. A circuit breaker in accordance with claim 8 including manually operated means for selectively moving said contact actuator member between said first and second positions to selectively close and open the contacts.

10. A circuit breaker in accordance with claim 9 including tripping means for moving said contact actuator member from the first to the second position in response to an overload condition.

* * * * *